US011485538B1

(12) United States Patent
Cacciabeve

(10) Patent No.: US 11,485,538 B1
(45) Date of Patent: Nov. 1, 2022

(54) MAGNETIC TRAY

(71) Applicant: Walter R. Tucker Enterprises, Ltd., Deposit, NY (US)

(72) Inventor: Robert Cacciabeve, Boonton, NJ (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 76 days.

(21) Appl. No.: 17/314,993

(22) Filed: May 7, 2021

(51) Int. Cl.
*B65D 6/24* (2006.01)
*B65D 43/22* (2006.01)
*B65D 43/16* (2006.01)

(52) U.S. Cl.
CPC ..... *B65D 11/188* (2013.01); *B65D 43/164* (2013.01); *B65D 43/22* (2013.01)

(58) Field of Classification Search
CPC .. B65D 2313/04; B65D 21/0234; B65D 5/66; B65D 11/188; B65D 43/164; B65D 43/22; A45C 13/1069
USPC ..... 220/4.28
See application file for complete search history.

(56) References Cited

U.S. PATENT DOCUMENTS 5,655,706 A * 8/1997 Vandiver ..... B65D 5/66 229/125.09
8,899,435 B1 * 12/2014 Reder ..... A47G 19/2205 220/630
10,822,661 B2 * 11/2020 Dahiya ..... C12Q 1/6886
2021/0147135 A1 * 5/2021 Rogers ..... B65D 81/389

OTHER PUBLICATIONS

E-Z Red Company, Expandable Magnetic Parts Quad Tray-Red, www.ezred.com, 2019, 5 Pages.
E-Z Red Company, Expandable Magnetic Parts Trays, www.ezred.com, 2019, 5 Pages.
Lowe's, Craftsman Automotive 2-Piece Collapsible Magnetic Tray, www.lowes.com, 2021, 6 Pages.
Matco Tools, Collapsible Magnetic Parts Cups, Set of 3, Part No. MMHCUP3, www.matcotools.com, Dec. 21, 2021, 1 Page.
Matco Tools, Collapsible Magnetic Parts Tray, Part No. MMHTRAYY4, www.matcotools.com, Dec. 21, 2021, 1 Page.

* cited by examiner

*Primary Examiner* — Shawn M Braden
(74) *Attorney, Agent, or Firm* — Breiner & Breiner, L.L.C.

(57) ABSTRACT

There is disclosed a magnetic tray having a first tray and a second tray connected to each other and which are the same or substantially the same. The first and second trays are collapsible and expandable. The first and second trays each include a body member adapted to be collapsible and expandable; a base member adapted to fit in the bottom of the body member and having a magnet on a first side of the base member and one or more magnets on a second side of the base member; and a collar member having a hinge member and a lock member. The first tray and the second tray are connected to each other by the hinge members. The first tray and the second trays are adapted to be separable by the hinge members.

9 Claims, 9 Drawing Sheets

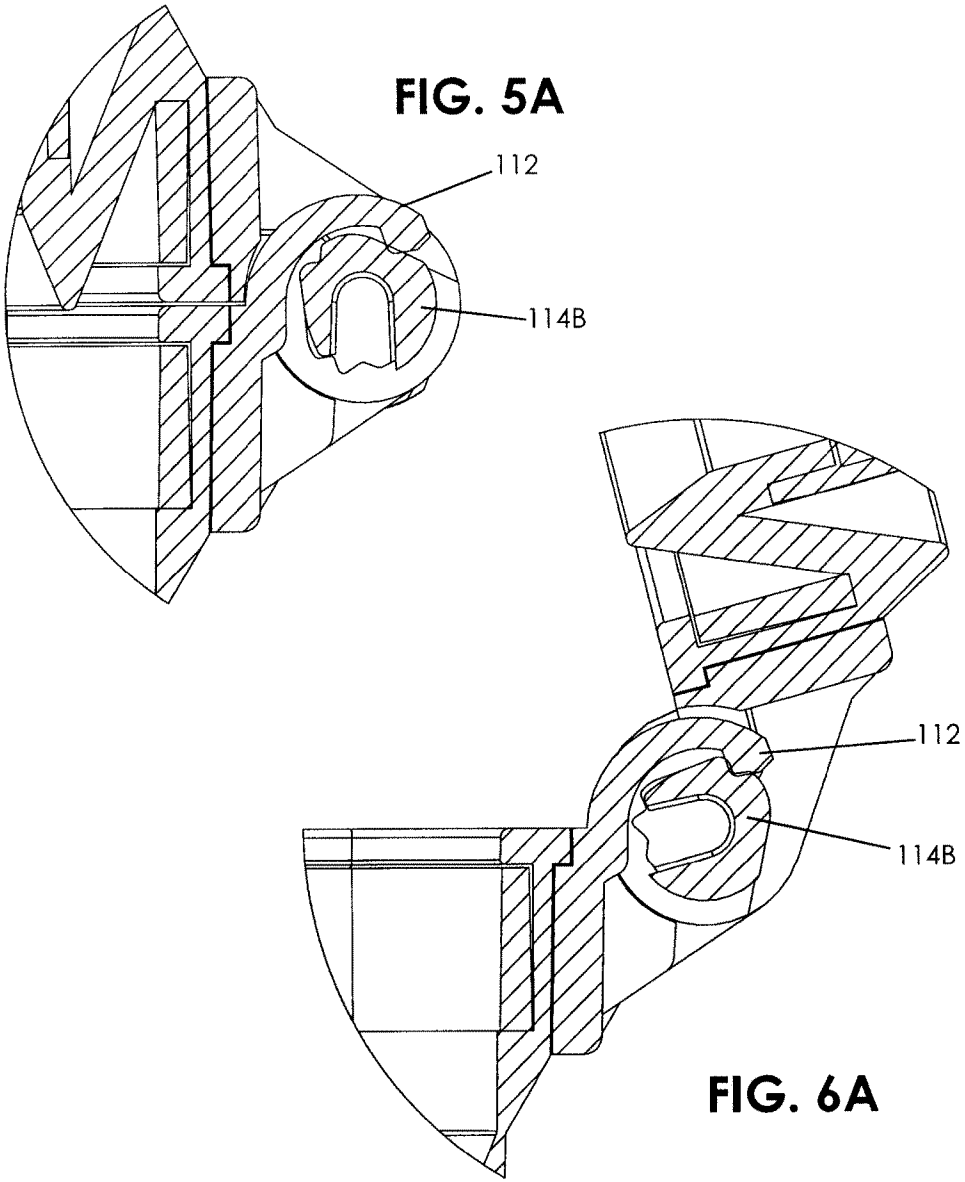
FIG. 5A
FIG. 6A
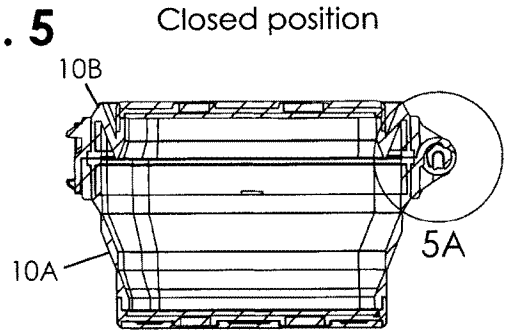
FIG. 5
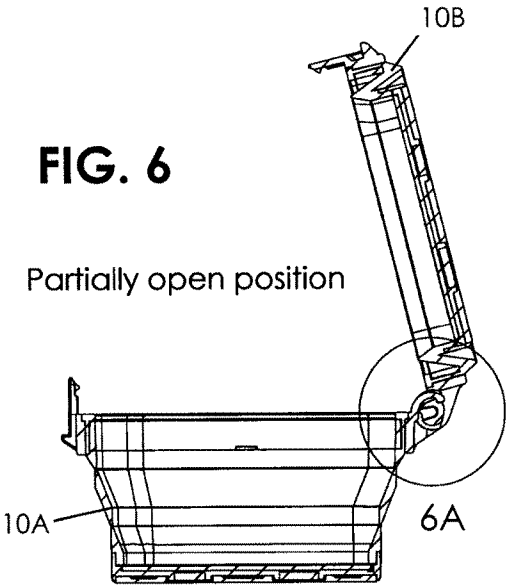
FIG. 6

MAGNETIC TRAY

FIELD OF THE INVENTION

The present invention relates to a magnetic tray which is collapsible and expandable. More particularly, the invention relates to a magnetic tray which is collapsible and expandable, and which comprises a first tray and a second tray connected to each other by a hinge wherein the first and second trays are substantially the same and may be separated at the hinge into two separate trays.

BACKGROUND OF THE INVENTION

Trays are useful for holding parts, fasteners and related articles when working in the automotive or other fields. This is especially true when working in tight spaces and not wanting to lose any of the parts, e.g. when taking a part off an automobile engine. Trays are known in the art which include a magnet in the base to hold articles. However, such trays do not include a closure for enclosing the parts when in transport or for attaching the tray to a work area or for separating into two separate trays.

Accordingly, while magnetic trays are known in the art, there is room for improvement. Thus, these known devices have various shortcomings which are addressed by the present invention.

SUMMARY OF THE INVENTION

A primary object of the invention is to provide a magnetic tray for holding hardware, fasteners, and other articles.

Another primary object of the invention is to provide a magnetic tray which is collapsible and expandable.

Another primary object of the invention is to provide a magnetic tray which includes a magnet for retaining articles on the inside of the tray and which includes one or more magnets for attaching the tray to a surface on or near a work area.

Another primary object of the invention is to provide a magnetic tray which includes a hinge and snap lock which allows for closure of the tray for transport or storage.

Another primary object of the invention is to provide a magnetic tray having a first tray and a second tray which may be connected to each other to provide a closable magnetic tray and which first tray and second tray are substantially the same.

Another primary object of the invention is to provide a magnetic tray having a first tray and a second tray which are substantially the same in design in order that they may be made by the same tooling and, therefore, be easy to tool, manufacture and replace.

Another primary object of the invention is to provide a magnetic tray having a first tray and a second tray connected by a hinge member wherein the hinge member is adapted to allow the trays to be separated to provide for two separate magnetic trays.

The present invention is directed to a magnetic tray comprising a first tray and a second tray connected to each other and which are substantially the same. The first and second trays of the magnetic tray are collapsible and expandable. The first tray includes a first body member adapted to be collapsible and expandable; a first base member adapted to fit in the bottom of the first body member and having a magnet on a first side of the first base member and one or more magnets on a second side of the first base member; and a first collar member having a first hinge member and a first lock member. The second tray includes a second body member adapted to be collapsible and expandable; a second base member adapted to fit in the bottom of the second body member and having a magnet on a first side of the second base member and one or more magnets on a second side of the second base member; and a second collar member having a second hinge member and a second lock member. The first tray and the second tray are connected to each other by the first hinge member and the second hinge member. The first body member, the first base member and the first collar member are substantially the same as the second body member, the second base member and the second collar member. The first tray and the second tray are adapted to be separable by the first hinge member and the second hinge member.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

REFERRING TO THE DRAWINGS

Figure 1:
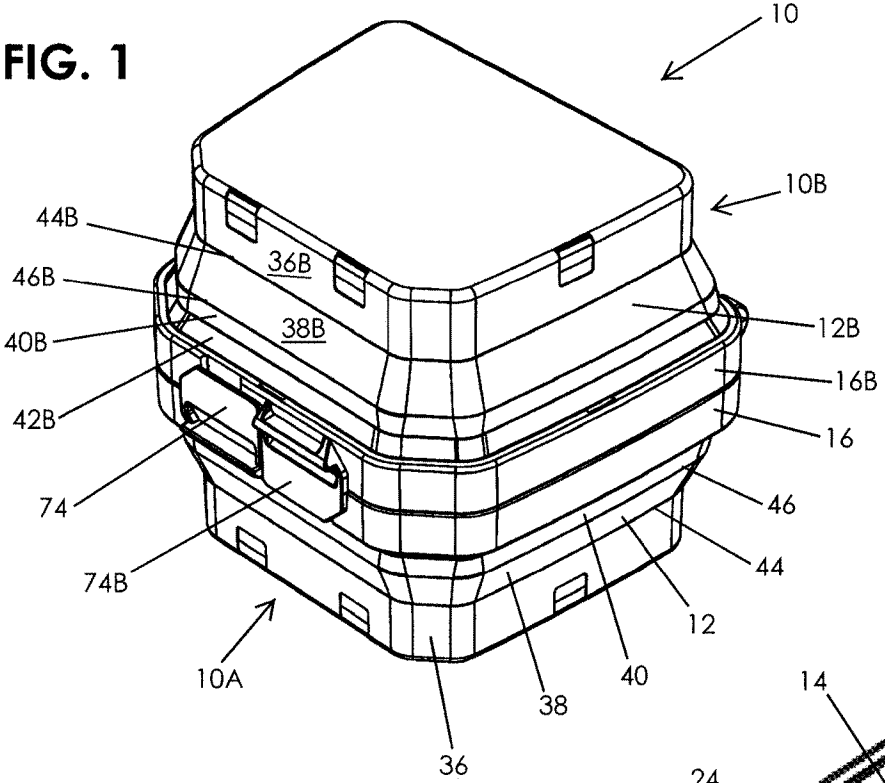

FIG. 1 is a front/side perspective view of the magnetic tray of the present invention in a closed and expanded position.

Figure 1A:
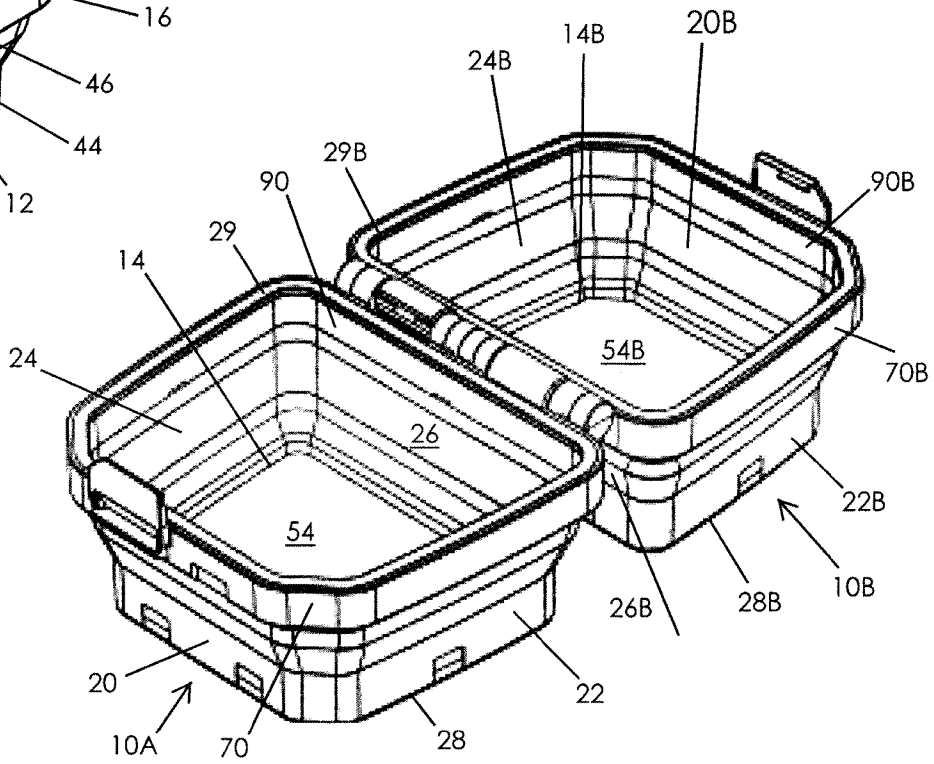

FIG. 1A is the magnetic tray of FIG. 1 in an open position.

Figure 1C:
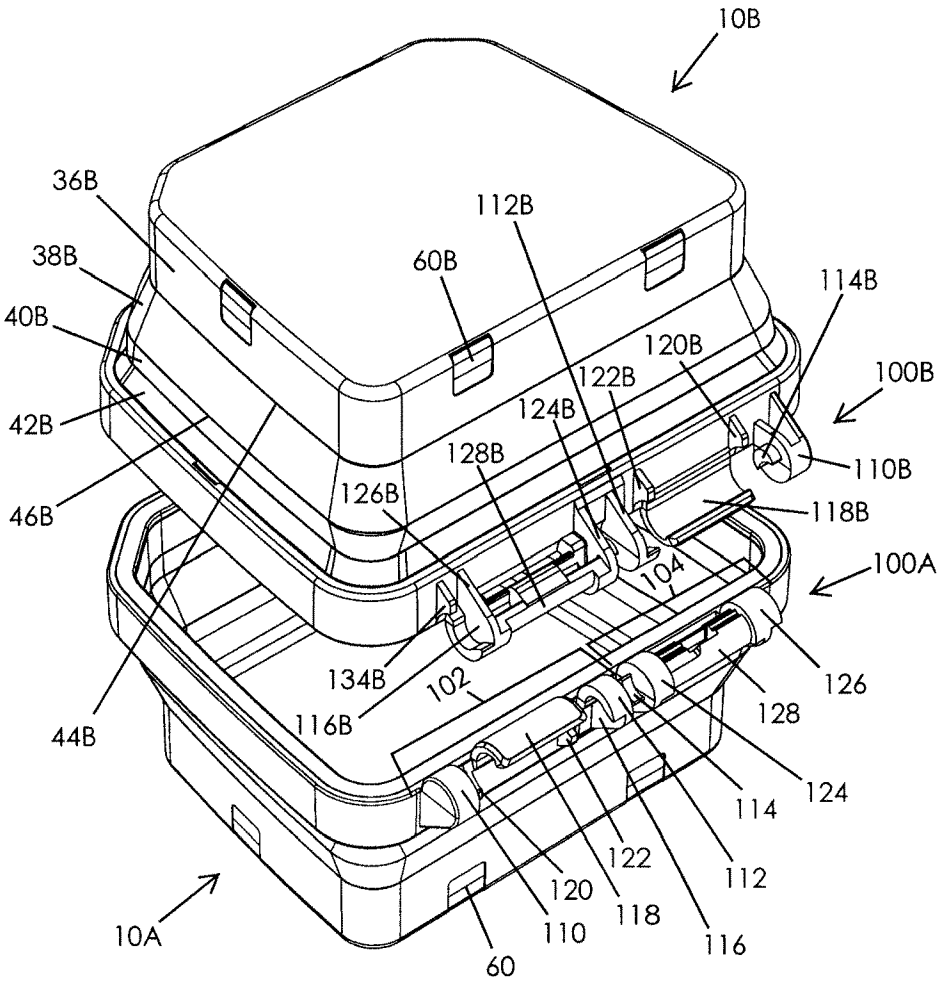
Figure 1B:
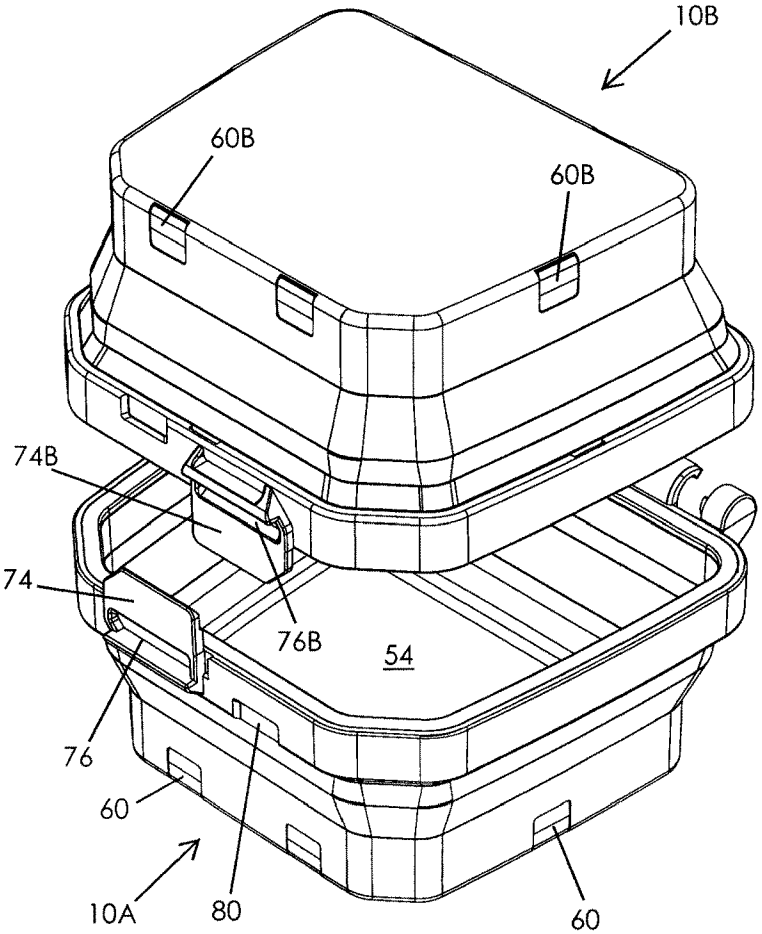

FIG. 1B is the magnetic tray of FIG. 1 separated into two trays.

FIG. 10 is a back/side perspective view of the trays of FIG. 1B.

Figure 2B:
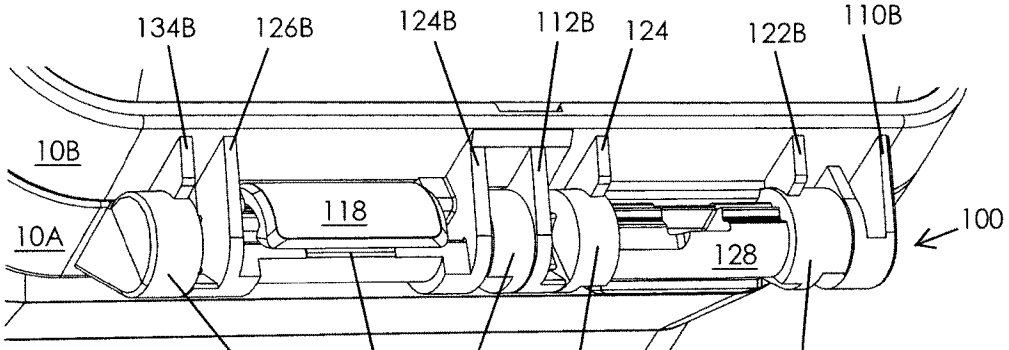
Figure 2C:
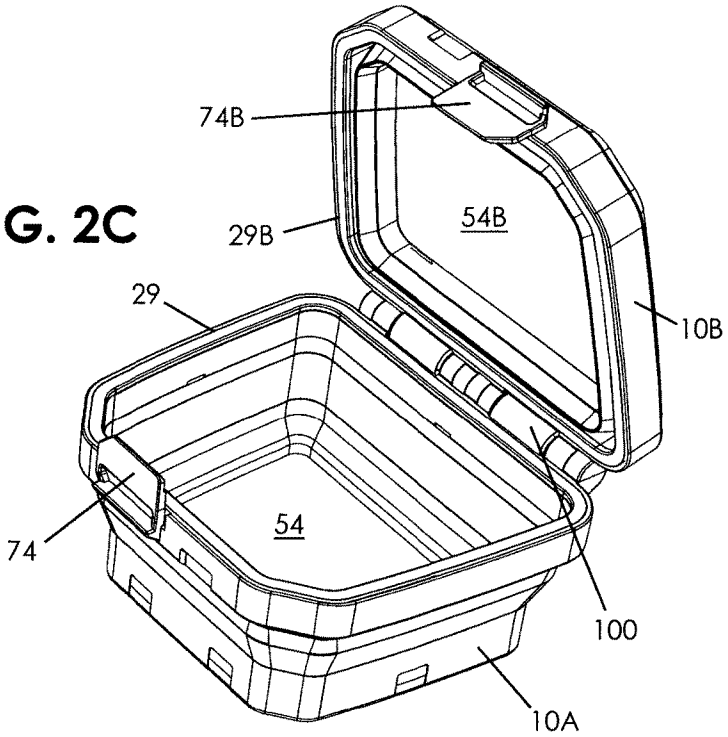
Figure 2:
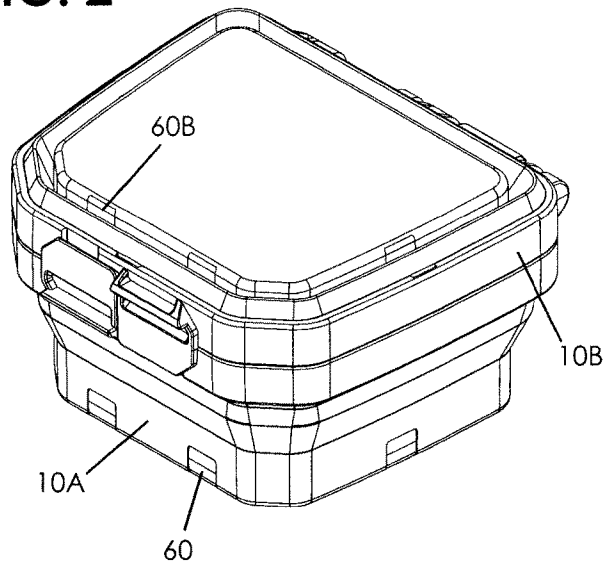
Figure 2A:
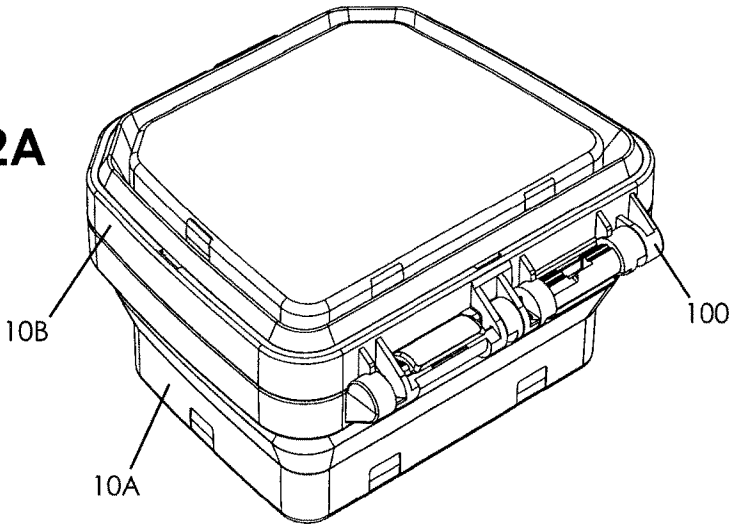

FIG. 2 is a front/side perspective view of the magnetic tray of the present invention in a closed and partially expanded position FIG. 2A is a side/back perspective view of the tray of FIG. 2.

FIG. 2B is a close up view of the hinge of the tray of FIG. 2A.

FIG. 2C is a front/side perspective view of the tray of FIG. 2 in a partially open position with one portion of the tray expanded and one portion of the tray collapsed.

Figure 2F:
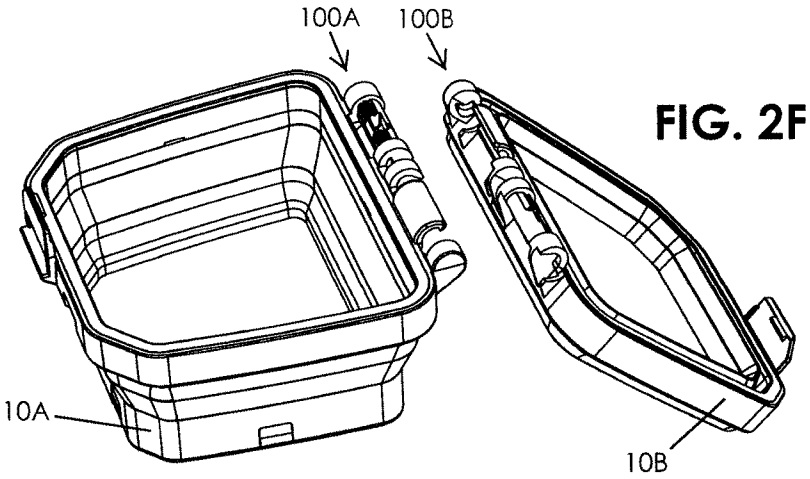
Figure 2G:
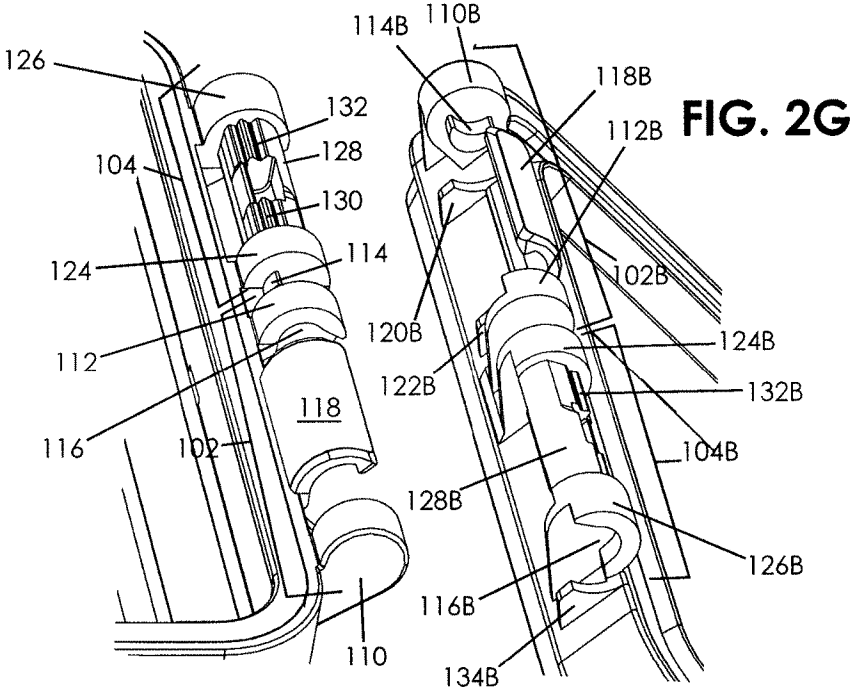
Figure 2D:
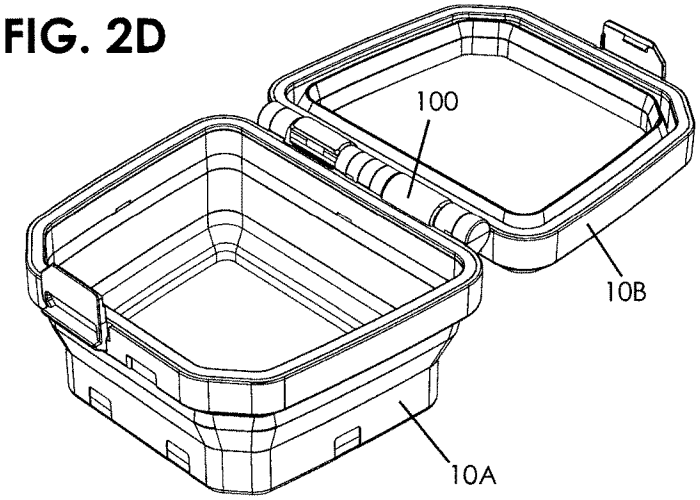

FIG. 2D is a front/side perspective view of the tray of FIG. 2 in a fully open position.

Figure 2E:
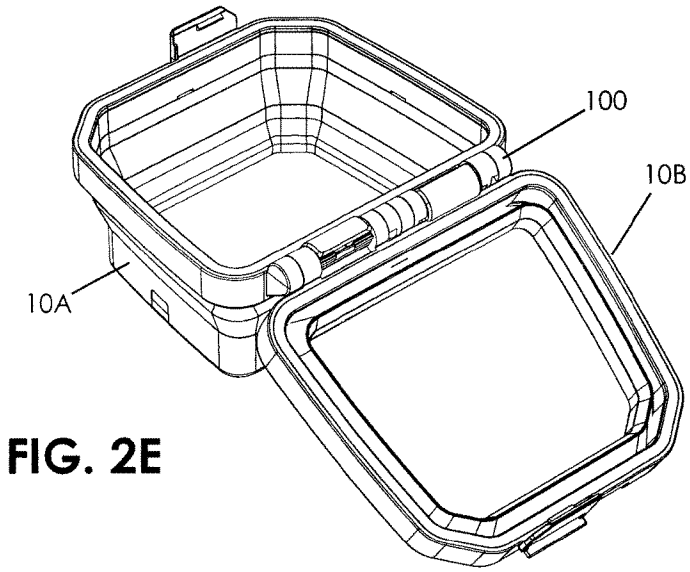

FIG. 2E is a side/back perspective view of the tray of FIG. 2 with one of the tray members pushed down for separating the trays as shown in FIG. 2F.

FIG. 2F is a side perspective view of the tray of FIG. 2 showing the first tray and the second tray separated to provide two separate magnetic trays.

FIG. 2G is an enlarged view of the hinge of the trays in FIG. 2F.

Figure 3A:
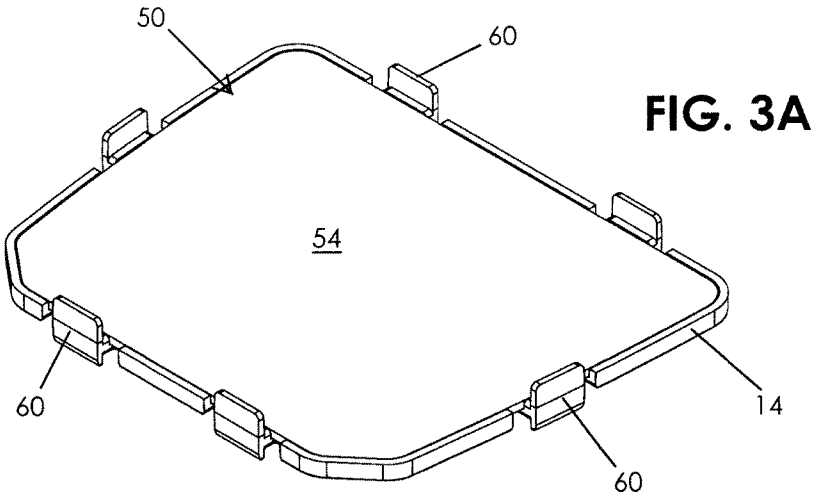
Figure 3B:
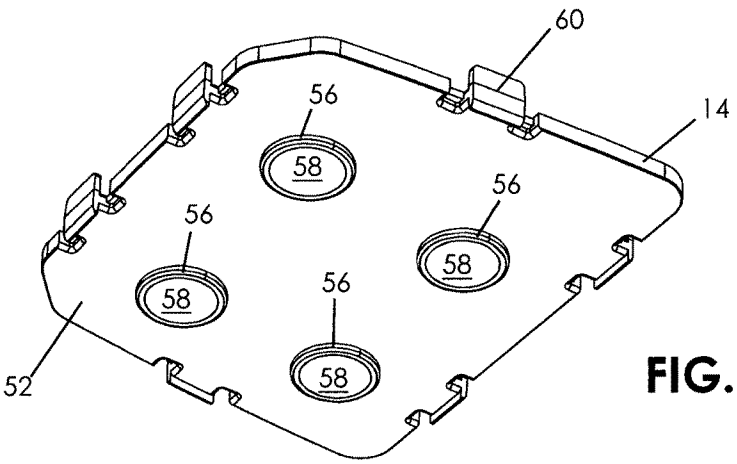
Figure 3:
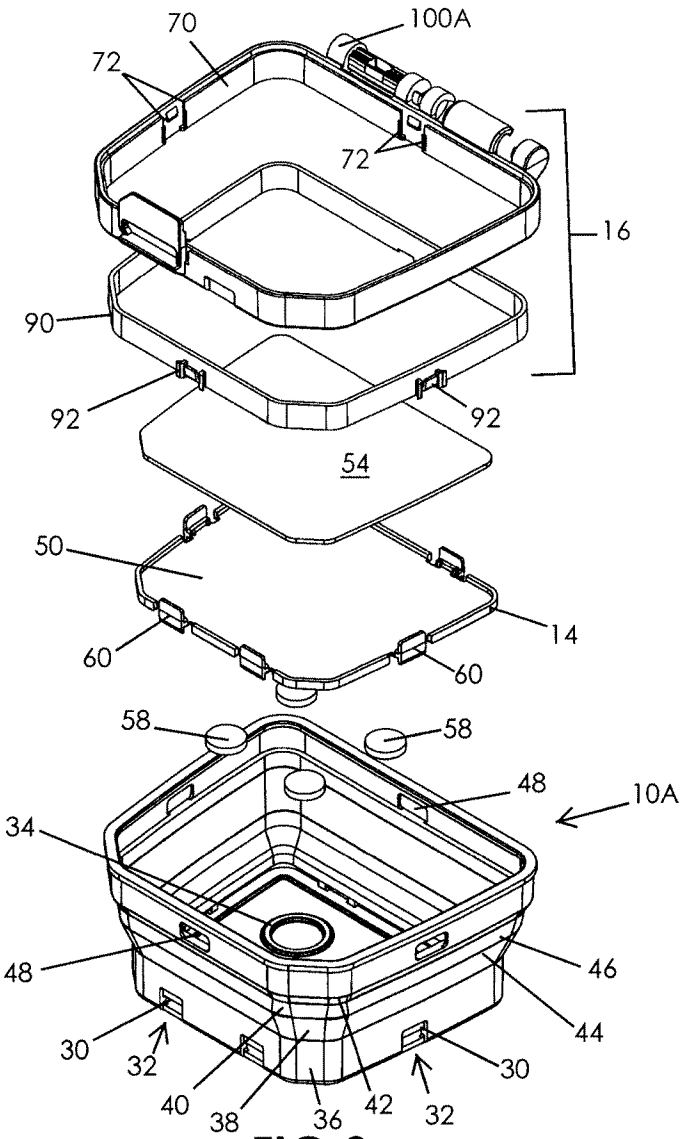

FIG. 3 is an exploded view of one tray of the magnetic tray of FIG. 1, the second tray being the same or substantially the same.

FIG. 3A is a top perspective view of the base of the tray of FIG. 1.

FIG. 3B is a bottom perspective view of the base of the tray of FIG. 1.

Figure 4A:
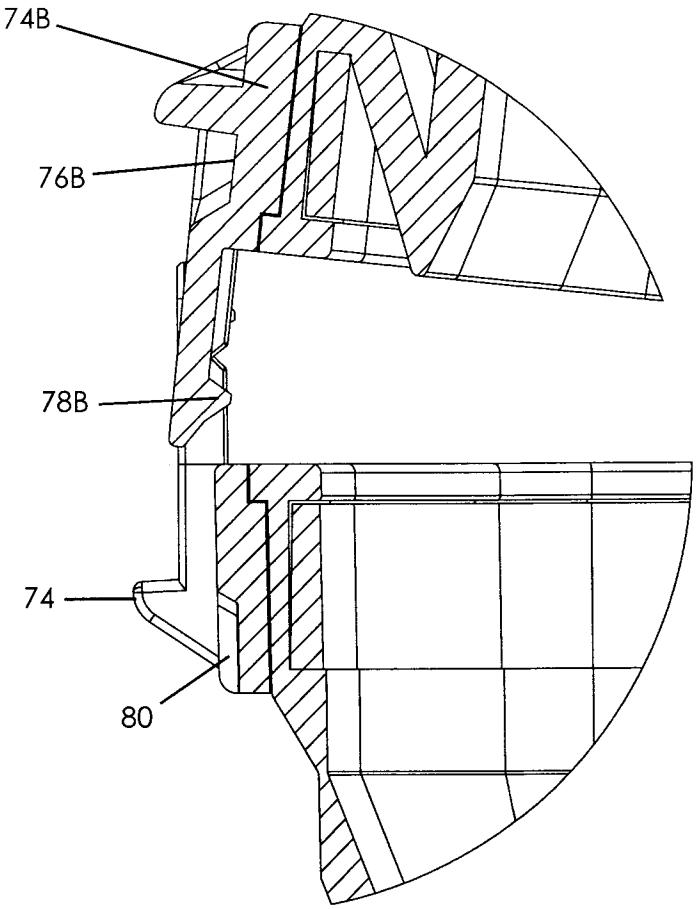
Figure 4:
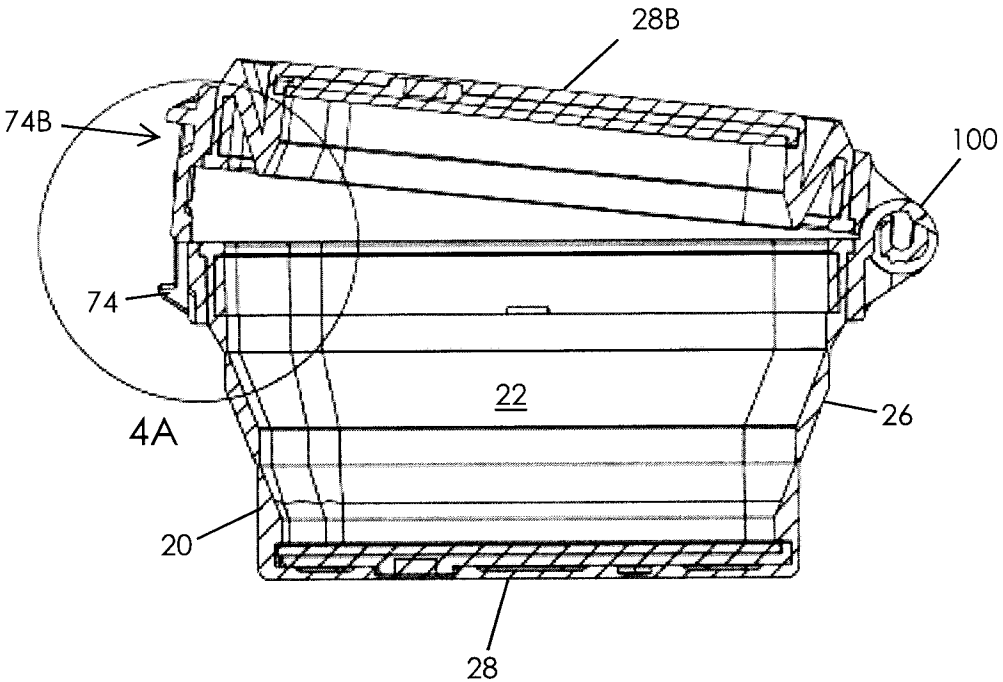

FIG. 4 is a side cross-sectional view of the tray of FIG. 2.

FIG. 4A is an enlarged view of section 4A of FIG. 4 showing the snap lock.

FIG. 5 is a cross-sectional view of the tray of FIG. 2 in the closed position.

FIG. 5A is an enlarged view of section 5A of FIG. 5 showing the hinge in a closed position.

FIG. 6 is a cross-sectional view of the tray of FIG. 2 in a partially open position.

FIG. 6A is an enlarged view of section 6A of FIG. 6 showing the hinge in a partially open position.

Figure 7A:
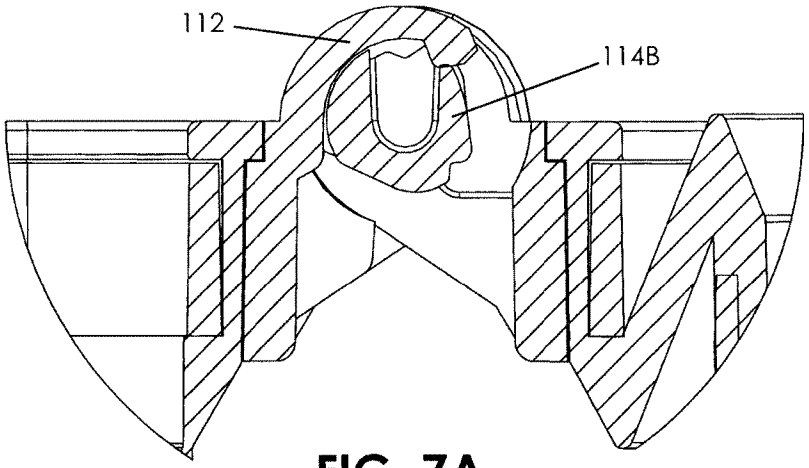
Figure 7:
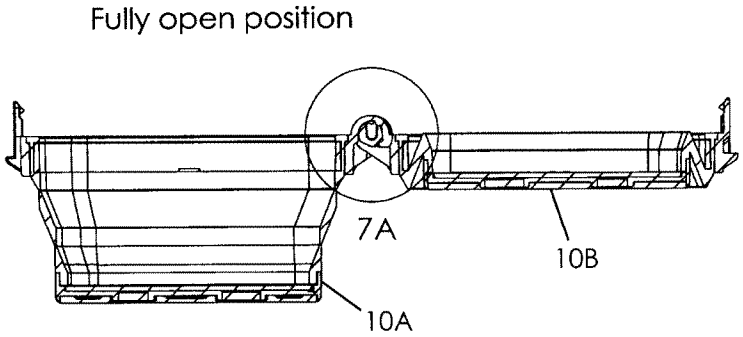

FIG. 7 is a cross-sectional view of the tray of FIG. 2D in a fully open position.

FIG. 7A is an enlarged view of section 7A of FIG. 7 showing the hinge in a fully open position.

Figure 8A:
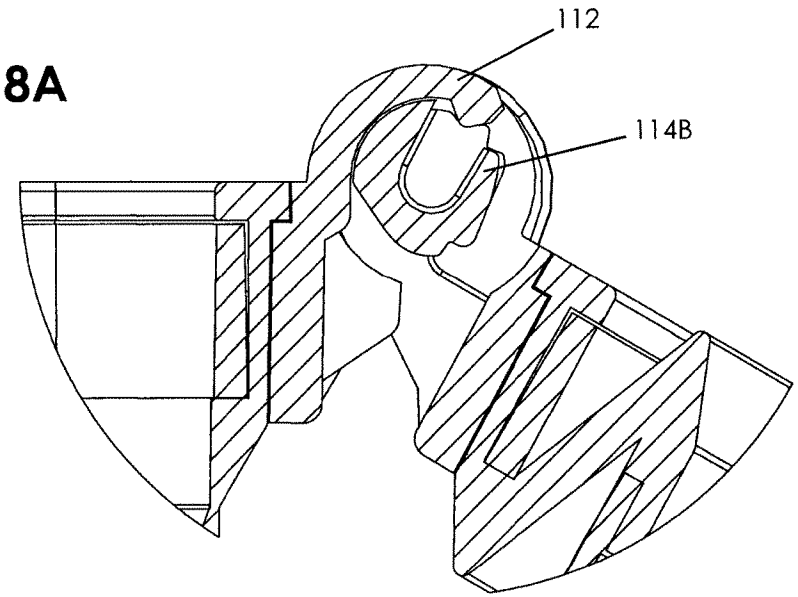
Figure 8:
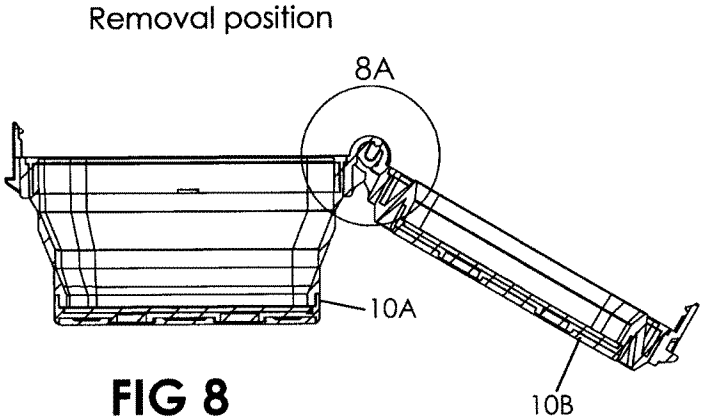

FIG. 8 is a cross-sectional view of the tray of FIG. 2E in a removal position.

FIG. 8A is an enlarged view of section 8A of FIG. 8 showing the hinge in a removal position.

Figure 9A:
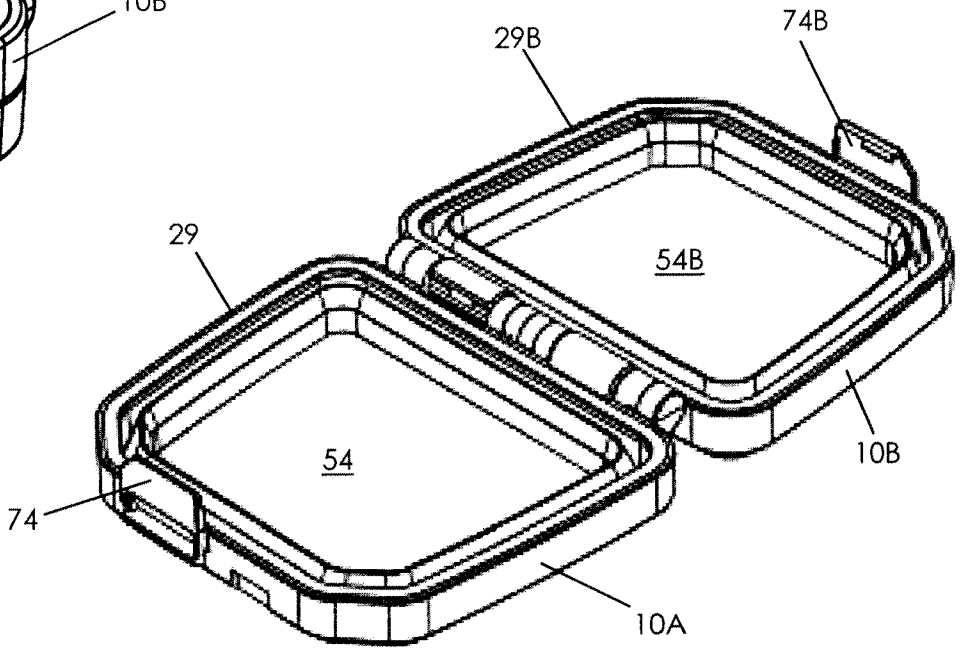
Figure 9:
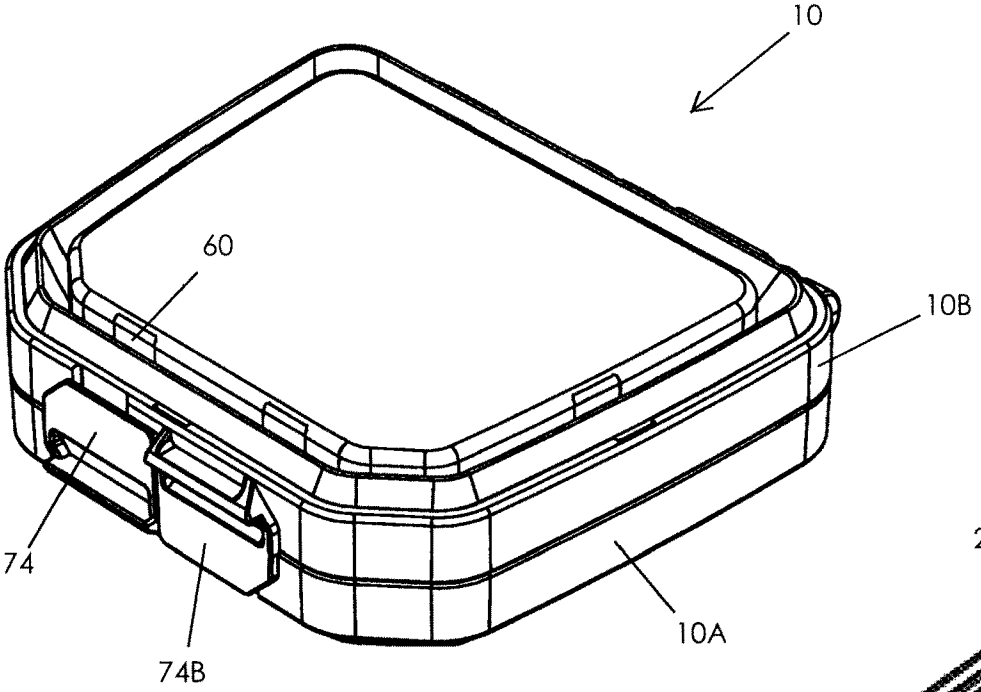

FIG. 9 is a front/side perspective view of the tray of FIG. 1 with both the first tray and the second tray in a collapsed position.

FIG. 9A is the tray of FIG. 9 in an open position.

DETAILED DESCRIPTION OF THE PREFERRED EMBODIMENTS

The invention is directed to a magnetic tray. More particularly, the invention is directed to a magnetic tray which is collapsible and expandable. The magnetic tray in the collapsed position, as shown in FIG. 9, makes the tray easy to carry and transport when not in use. The magnetic tray when in the expanded position as shown, for example, in FIGS. 1 and 1A provides a substantial area for retaining articles in the tray and the tray may be closed and carried in the expanded position to another work area. The magnetic tray includes a first tray and a second tray connected to each other by the hinges of the magnetic tray and which may be closed or which first tray and second tray may be separated to provide two separate magnetic trays without a cover for closure. The first and second trays are the same or substantially the same making the expense of tooling, manufacture and assembling the magnetic tray simple and less expensive. Each of the first and second trays of the magnetic tray include a base on the inside of the magnetic tray with a magnet on the top side of the base for holding articles inside the tray and one or more magnets on the bottom side of the base for attaching the magnetic tray to a ferrous surface such as the underside of an automobile hood. FIGS. 1-9A show various aspects of the magnetic tray of the invention as discussed below.

Referring to FIGS. 1-1C, the invention is directed to a magnetic tray 10. The magnetic tray 10 comprises a first tray 10A connected to a second tray 10B. Trays 10A and 10B are the same or substantially the same. Referring, for example, to FIGS. 1-1C and 3-3B, tray 10A includes a body 12, a base 14, and a collar 16. Referring, for example, to FIGS. 1A-1C, tray 10B includes a body 12B, a base 14B and a collar 16B. It is understood that the first and second trays 10A and 10B are the same or substantially the same. In a preferred embodiment, tray 10A and tray 10B are the same. Accordingly, the description of the first tray 10A is the same for tray 10B. The parts of the tray 10A will be described in further detail below and the parts are the same for tray 10B followed by the letter "B.".

Body 12 is made of a soft flexible material such polypropylene. Body 12 includes a front wall 20, side walls 22 and 24, back wall 26 and bottom wall 28. Each of these walls include a recess 30 and opening 32 for connecting the base 14 to the bottom of body 12 as discussed below. Bottom 28 incudes on the inside thereof four annular rings 34 for receiving magnets 58 as discussed below. Body 12 includes panels 36, 38, 40 and 42 and fold lines 44 and 46. Each panel 36, 38, 40 and 42 has a smaller width from the bottom panel 36 to the top panel 42, thereby allowing for the collapsing and expanding of body 12 along fold lines 44 and 46. Body 12 further includes openings 48 in each of the front, side and back walls for attaching collar 16 to body 12 as discussed below.

Base 14 is made of a hard plastic such as ABS (acrylonitrile butadiene styrene). Base 14 includes a first side 50 and second side 52. First side 50 is adapted to receive a magnet 54 preferably attached to the top side by an adhesive. Magnet 54 is preferably a soft magnet. Second side 52 includes annular rings 56 adapted to receive magnets 58 in the recess created by annular rings 56. Magnets 58 are preferably neodymium magnets. Annular rings 56 with magnets 58 seat in annular rings 34. Base 14 further includes clips 60 for attaching base 14 at the bottom of body 12 whereby the clips 60 extend through openings 32 of body 12 and are seated in recesses 30 of body 12 such that the clips are flush with the walls of body 12.

Collar 16 is made of a hard plastic such as ABS. Collar 16 comprises an outer collar 70 and an inner collar 90. Inner collar 90 seats inside body 12 adjacent to rim 29 of body 12 and includes spring clips 92 which extend through openings 48 in body 12 for connection to grooves 72 of outer collar 70. Referring, for example, to FIGS. 4 and 4A, outer collar 70B of tray 10B includes a snap lock 74B which includes a finger grip 76B and a locking lip 78B. Outer collar 70 further includes a recess or groove 80 for receiving the corresponding locking lip 78B of tray 10B.

Outer collars 70 and 70B include a hinge 100 comprising a hinge 100A on tray 10A and hinge 100B on tray 10B. Hinge 100A will be described herein with the understanding that hinge 100B is the same or substantially the same. Hinge member 100A includes a first hinge member 102 and a second hinge member 104. First hinge member 102 comprises a male member 110 and a female member 112. Male member 110 includes a crescent shaped pin 114 for ease of removal and attachment of the first and second hinge members 100A and 100B of tray 10A and tray 10B. Female member 112 has a wide entry point 116, approximately one half the circumference of female member 112, to allow male member 124B with pin 114B to be able to come apart and re-engage. First hinge member 102 further includes a hook 118 extending outwardly from the outer collar 70 and detents 120 and 122. The second hinge member 104 comprises male member 124 and female member 126 which corresponds in structure to male member 110 and female member 112, respectively, and a barrel 128 therebetween. Barrel 128 includes teeth 130 and 132 and a detent 134. When hinges 100A and 100B are connected as shown, for example, in FIG. 2B, the magnetic tray 10 may be opened and closed and maintained closed by snap locks 74 and 74B. Trays 10A and 10B will rotate from an open position to a position for separating the trays to 70°, 180° and 190° in a generally ratcheting movement.

As seen above, each hinge 100A,100B of tray 10A and tray 10B includes a hook 118,118B and a barrel 128,128B. The hook 118 of tray 10A meets up with the barrel 128B on tray 10B and the hook 118B meets up with the barrel 128 of tray 10A. This provides the snap/detent mechanism that allows the trays 10A and 10B to be positioned at multiple angles. The design further allows for the trays 10A and 10B to be separated if opened far enough, e.g. 190°, as shown in FIGS. 2E and 2F. Trays 10A and 10B when separated may be reattached to form magnetic tray 10 by reversing the process. Proper alignment of the hinges 100A,100B is required for the two parts to engage. Once engaged the hinge can be articulated. The male members 110,110B,124,124B and female members 112,112B,126,126B when aligned provide rotational stability to the hinge, keeping the entire hinge mechanism aligned as the hinge is articulated. Without these features, the hinge would not be able to keep on one common axis as the user tries to articulate the hinge. As noted, the pins 114,114B on the male members 110,110B, 124,124B have a crescent shape to ease removal and attachment of the hinge. If the pins 114,114B were a complete cylinder the hinge would not be able to come apart and re-engage. Similarly, the female members 112,112B,126, 126B have a wide entry point 116,116B to allow the male feature to engage and disengage easily. The combination of multiple male members 110,110B,124,124B and female members 112,112B,126,126B working together at different orientations throughout the rotation of the hinge provides the stability needed—as if the male and female members were built as uninterrupted cylinders, as one would have in a permanent hinge assembly—not a hinge designed to detach.

Tray 10 may be broken into two trays 10A and 10B as shown in FIG. 2F. The process is shown in FIGS. 5-8A and 2-2G. FIGS. 5 and 5A show the tray 10 in a closed position and the relationship between the female member 112 and male member 114B and corresponding to FIG. 2. FIGS. 6 and 6A show the tray 10 in a partially open position and shows the rotational movement of the male member 114B of the hinge in further relation to the female member 112 and corresponding to FIG. 2C. FIGS. 7 and 7A show the tray 10 in a fully open position and the further rotational movement of the male member 114B in relation to the female member 112, and corresponding to FIG. 2D. Referring to FIGS. 8 and 8A, tray 10B is moved downward to remove tray 10B from tray 10A, and corresponding to FIG. 2E. The male member 114 is now able to disengage from the female members 112. This cross-section is applicable to each of the male and female members of the hinges.

Referring to the Figures, there is shown various positions of tray 10. Specifically, FIG. 9 shows a front/side perspective view of both the first and second trays in a collapsed position. FIG. 9A is the tray of FIG. 9 in an open position. FIG. 1 is a front/side perspective view of the tray 10 in a closed position with both the first tray and the second tray in an expanded position. FIG. 1A is the tray of FIG. 1 in an open position. FIG. 2 is a front/side perspective view of tray 10 in the closed position with 10A expanded and tray 10B collapsed. FIG. 2D shows the tray 10 of FIG. 2 in a fully open position.

In use, tray 10 may be used in a number of configurations. For example, tray 10 as shown in FIG. 2, may be placed on the underside of an automobile hood with bottom 28 of tray 10A being magnetically attached to the hood. A worker may take parts from the automobile engine and place them in tray 10A to be held by magnet 54. Tray 10B in this instance may not be used and be open at a 70° angle. Similarly, the tray 10 of FIG. 1 may be placed on a horizontal metal surface adjacent a work area and parts or fasteners may be placed in the tray for use at the work area. In another use, trays 10A and 10B may be separated to provide for two separate trays wherein the trays are placed on a work area and magnetically adhered by the magnets 58 at the bottoms 28 and 28B of trays 10A and 10B and parts or fasteners maintained in trays 10A and 10B by magnets 54 and 54A. The uses are almost limitless.

Since trays 10A and 10B are the same, they may be made in the same mold. This saves on expense. Additionally, a purchaser may replace one of the trays with a new tray since hinges 100A and 100B are made to engage and disengage.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A magnetic tray comprising:

a first tray comprising a first body member adapted to be collapsible and expandable, a first base member adapted to fit in the bottom of the first body member and having a magnet on a first side of the first base member and one or more magnets on a second side of the first base member, a first collar member adapted to be connected to the first body member having a first hinge member and a first lock member, and a second tray comprising a second body member adapted to be collapsible and expandable, a second base member adapted to fit in the bottom of the second body member and having a magnet on a first side of the second base member and one or more magnets on a second side of the second base member, a second collar member adapted to be connected to the second body member having a second hinge member and a second lock member, wherein the first tray and the second tray are connected to each other by the first hinge member and the second hinge member, and wherein the first body member, the first base member and the first collar member are substantially the same as the second body member, the second base member and the second collar member.

2. The magnetic tray of claim 1 wherein the first tray and the second tray are adapted to be separable to provide two separate magnetic trays through the rotation of the first tray or the second tray on the first hinge member and the second hinge member.

3. The magnetic tray of claim 2 wherein the first hinge member comprises a first hinge portion including a male member, a female member, a hook and one or more detents and adapted to engage a barrel member of the hinge of the second tray and a second hinge portion comprising a male member, a female member, a barrel member and a detent and adapted to engage a hook member of the second tray.

4. The magnetic tray of claim 3 wherein the second tray is adapted to rotate on the first hinge and second hinge member to a plurality of positions.

5. The magnetic tray of claim 1 wherein the magnet on the first side of the first base member and the magnet on the first side of the second base member are soft magnets.

6. The magnetic tray of claim 5 wherein the one or more magnets on the second side of the first base member and the one or more magnets on the second side of the second base member are neodymium magnets.

7. The magnetic tray of claim 1 wherein the one or more magnets on the second side of the first base member and the one or more magnets on the second side of the second base member are neodymium magnets.

8. The magnet tray of claim 1 wherein the first lock member and the second lock member are snap-lock members.

9. The magnetic tray of claim 1 wherein the first collar member and the second collar member comprise inner and outer collar members.

* * * * *